US006578308B2

(12) United States Patent
Hickerson

(10) Patent No.: US 6,578,308 B2
(45) Date of Patent: Jun. 17, 2003

(54) FIREARM SAFETY DEVICE

(76) Inventor: Frederick R. Hickerson, 15 Slate Pencil Hill Rd., Newton, NJ (US) 07860

( * ) Notice: Subject to any disclaimer, the term of this patent is extended or adjusted under 35 U.S.C. 154(b) by 0 days.

(21) Appl. No.: 09/821,614

(22) Filed: Mar. 29, 2001

(65) Prior Publication Data

US 2001/0034961 A1 Nov. 1, 2001

Related U.S. Application Data

(63) Continuation-in-part of application No. 09/543,285, filed on Apr. 5, 2000.

(60) Provisional application No. 60/205,912, filed on May 22, 2000, and provisional application No. 60/135,625, filed on May 24, 1999.

(51) Int. Cl.[7] ..... F41A 17/00

(52) U.S. Cl. ..... 42/70.11; 42/96

(58) Field of Search ..... 42/70.11, 70.01, 42/96

(56) References Cited

U.S. PATENT DOCUMENTS

| | | | | | |
|---|---|---|---|---|---|
| 2,478,098 | A | | 8/1949 | Hansen | 42/1 |
| 2,479,107 | A | | 8/1949 | Garretson | 42/70 |
| 2,887,807 | A | | 5/1959 | Santangelo | 42/1 |
| 2,937,666 | A | * | 5/1960 | Maisch | 138/89 |
| 3,154,874 | A | * | 11/1964 | Stewart | 42/70.11 |
| 3,768,189 | A | | 10/1973 | Goodrich | 42/1 N |
| 4,023,294 | A | | 5/1977 | Knopp | 42/1 LP |
| 4,084,341 | A | | 4/1978 | Cervantes | 42/1 LY |
| 4,136,476 | A | | 1/1979 | Hetrick | 42/1 LP |
| 4,224,753 | A | | 9/1980 | Bielman | 42/1 LP |
| 4,479,320 | A | | 10/1984 | Fix | 42/1 LP |
| 4,512,099 | A | | 4/1985 | Mathew | 42/1 LP |
| 4,569,144 | A | | 2/1986 | Thurber | 42/1 LP |
| 4,783,924 | A | | 11/1988 | Thurber | 42/70.11 |
| 4,908,971 | A | | 3/1990 | Chaney | 42/70.11 |
| 5,001,854 | A | | 3/1991 | Derman | 42/70.11 |
| 5,048,211 | A | | 9/1991 | Hepp | 42/70.11 |
| 5,062,233 | A | * | 11/1991 | Brown | 42/70.11 |
| 5,233,777 | A | * | 8/1993 | Waterman et al. | 42/70.11 |
| 5,241,770 | A | * | 9/1993 | Lambert | 42/70.11 |
| 5,392,552 | A | | 2/1995 | McCarthy et al. | 42/70.07 |
| 5,488,794 | A | | 2/1996 | Arrequin | 42/70.11 |
| 5,561,935 | A | | 10/1996 | McCarthy et al. | 42/70.07 |
| 5,664,358 | A | * | 9/1997 | Haber et al. | 42/44 |
| 5,918,403 | A | * | 7/1999 | Lurz et al. | 42/66 |
| 6,405,472 | B1 | * | 6/2002 | Dojcsak | 42/70.01 |

OTHER PUBLICATIONS

Bore Loc Alchemy Arms, Firearm Safety Lock Auburn, Wash. 98002.

* cited by examiner

*Primary Examiner*—Michael J. Carone
*Assistant Examiner*—M. Thomson

(57) ABSTRACT

An improved firearm safety device for handguns is disclosed. The firearm safety device (10) prevents accidental firing of a gun by children, but is easily removable by an adult in 5 to 10 seconds, even in pitch darkness. The firearm safety device includes a lock sleeve (26) having an expandable end plug (30) and a lock rod (24) having a removable tip (34), which are inserted through muzzle (16) of a gun barrel (14) into an empty firing chamber (20). Removable tips, having different diameters, provide the proper expansion for different caliber handguns. A knurled cap (22), connected to the lock rod, is threadedly attached to a knurled enlarged end portion (28) of the lock sleeve, forcing the expansion of the linear slotted (32) end plug, preventing removal of the firearm safety device from the handgun. Since the safety device is able to rotate freely in its assembled position within the handgun, any attempt to unthread the knurled cap without holding the knurled enlarged end portion of the lock sleeve stationary, will be unsuccessful.

9 Claims, 6 Drawing Sheets

FIREARM SAFETY DEVICE

CROSS REFERENCE TO RELATED APPLICATION

The following U.S. patent applications are hereby incorporated by reference herein, as though fully set forth at length:

Nos. 60/135,625, 60/205,912 and Ser. No. 09/543,285.

This application is a continuation in part and claims benefit of the filing dates of provisional applications Nos. 60/135,625; 60,205,912 and parent case 09/543,285 filed Apr. 5, 2000.

BACKGROUND

1. Field of Invention

This invention relates to safety for firearms, specifically a device to securely block the chamber and barrel of a firearm to prevent its firing.

2. Description of Prior Art

Children and other people are injured or killed by accidental shootings from loaded firearms which do not have preventative safety devices and which have been carelessly placed or stored where children can gain access to them. It has been estimated that Americans keep 200 million handguns in their homes.

Inventors and firearms manufacturers are working to develop and market "Personalized Smart Guns", ones that only the owner can fire. Smart gun inventions disclose a wide variety of safety lock systems, including thumb print recognition, ring or wristwatch radio controlled device, keypunch lock control and magnetic ring control. Gun owners are not enthusiastic about using smart guns, with batteries, electronics and magnets, because of the added cost and their questionable reliability for functioning properly and timely in emergency situations. Most gun owners who have handguns for emergency personal and family protection, will continue to utilize the existing conventional handguns with proven high reliability. With so many millions of conventional handguns out there, a comparative small number of "smart guns" if successfully developed and marketed, will make an insignificant difference in overall firearm safety.

For existing firearms and those still being sold, numerous patented safety devices to childproof these firearms have been invented and some are now on the market. Most of these safety devices either prevent access to the trigger or prevent a cartridge from being chambered or fired. Most gun owners will remove, or not install, these safety devices on a firearm which is positioned for emergency use, since all known marketed safety devices require unacceptable delays to ready for use.

U.S. Pat. Nos. 5,392,552 and 5,561,935 both issued to McCarthy are examples of the "clam shell" type trigger lock, and U.S. Pat. No. 4,084,341 issued to Cervantes is an example of "block" type trigger lock. A variety of locks, including key, dial roller, combination, illuminated digital and others are used to prevent removal of trigger safety devices.

One concern about trigger locks and trigger blocks is that a careless gun owner will leave a live cartridge in the firing chamber of the gun and a child might cock the hammer into its firing position. The child might then continue to monkey around the trigger or drop the gun possibly causing it to fire. Also, gun owners are concerned with the effects gun locks have on their sense of security. Today's locks are mechanical devices requiring keys, combinations and other things that a person might not easily remember or locate in the middle of the night during an emergency situation. While some states mandate trigger lock devices for guns that are sold, these devices don't solve the real problem of child proofing all handguns in a manner that the gun owner can, in an emergency, easily remove the safety device in 5 to 10 seconds in pitch darkness, i.e. to defend oneself and family U.S. Pat. No. 4,136,476 issued to Hetrich, U.S. Pat. No. 4,224,753 issued to Beilman, and U.S. Pat. No. 4,908,971 issued to Chaney are examples of safety devices that have a dummy cartridge to block the chamber which is held in place by a key controlled barrel rod.

The barrel block safety devices that attach to a dummy cartridge in the chamber assure that a live cartridge cannot be chambered and fired. Generally a key rod fastens and unfastens the barrel block from the dummy cartridge. The amount of time required to find and use the key rod to remove the block from the gun barrel, remove the dummy cartridge and load the gun is not acceptable to the gun owner in an emergency situation.

U.S. Pat. No. 4,023,294 issued to Knopp, U.S. Pat. No 4,512,009 issued to Mathew, U.S. Pat. No 4,569,144 issued to Thurber, U.S. Pat. No. 5,001,854 issued to Derman, and U.S. Pat. No. 5,048,211 issued to Hepp are examples of safety devices which block the barrel and firing chamber by use of rods and rod removal keys, cables and other required items.

The barrel and firing chamber blocker safety devices, including cable locks, prevent a cartridge from being in the firing chamber and for that reason have a safety advantage over the trigger locks and trigger blockers which allow a cartridge in the firing chamber. The disadvantage of the cable locks and other barrel blockers is their requirement for keys, combinations, special key rods and the like, which cause an unacceptable delay for the gun owner in removal of the safety device in emergency situations, where every second counts.

My firearm safety device in the parent invention, U.S. patent application Ser. No. 09/543,285 dated Apr. 5, 2000, is basically a barrel and firing chamber blocker. This patent application teaches a child proof locking means which requires no keys, combinations, electronic devices or the like, and can be easily and quickly removed by the gun owner in an emergency. In addition, my patent application teaches a secondary higher level, safety system, for non-emergencies utilizing an additional locking device. All other known barrel block safety devices that go through the barrel and into the firing chamber have a removal system requiring a key rod, a cable, or a digital padlock, which causes an unacceptable delay for the gun owner in an emergency situation. These devices, which are relatively complex mechanically and expensive are better from a safety standpoint than the trigger lock device.

SUMMARY OF THE INVENTION

The present invention is a firearm safety device for handguns and is designed to prevent accidental firing of a gun. The gun cannot contain a live cartridge in the firing chamber with the safety device in position; however, the safety device can be removed quickly, even in the dark, by following a proper removal procedure which is childproof The firearm safety device for handguns includes a lock sleeve with an expandable end plug and a lock rod having a removable tip, which are inserted into the handgun barrel blocking the firing chamber. A knurled cap connected to the lock rod, threadedly attaches to a knurled enlarged end portion of the lock sleeve, preventing removal of the firearm safety device from the handgun. Since the safety device is able to rotate freely in its assembled position in the gun, any attempt to unscrew the knurled cap without holding the knurled enlarged end portion of the lock sleeve stationary will be unsuccessful. A child will not be able to remove the knurled cap since he or she will hold the gun in one hand while fiddling with the knurled cap with the other hand.

OBJECTIVES AND ADVANTAGES

This invention is a continuation-in-part of my original firearms safety device invention as cross referenced above, and includes improvements based on development, fabrication and testing of invention models.

It is an object of my invention to provide a firearm safety device which may be easily applied to any handgun, has improved safety for children, and fulfills the gun owner's requirement for simple and fast removal.

It is a further object of my invention to provide a firearm safety device which can be positioned on new and used handguns of any caliber and any barrel length using a minimum of different components in order to enhance production and marketing.

It is also an object of my invention to provide a firearm safety device which, when positioned in a handgun, prevents a cartridge being in the firing chamber. Many other firearm safety devices such as clam shell type trigger lock, barrel locks, and trigger blocks are not designed to prevent a cartridge from being in the firing chamber, and for this reason are considered dangerous. It is an accepted fact that dropping a loaded gun can sometimes result in its discharge.

Another object of my invention is to provide such a firearm safety device which is installable and removable entirely from the muzzle end of a gun barrel, without any scratching or other damage to the firearm.

Yet another object of my invention is to provide a firearm safety device of simple, rugged construction and with a high reliability of working properly.

Still another object of my invention is to provide a firearm safety device, which can be totally or partially made of tough plastic material, which can be inexpensively molded using current production machines and techniques.

A further object of my invention is to provide a firearm safety device which is childproof but can be removed from a firearm by an adult in 5 to 10 seconds, in pitch darkness by using only a small physical force.

Another object of my invention is to provide a firearm safety device that when positioned in a handgun will extend out of the muzzle of the gun barrel as an indication that the firearm safety device is positioned within the handgun and no cartridge is in the firing chamber.

Also an object of my invention is to provide a firearm safety device with a tamper evident indicator which will tell the gun owner at a glance whether someone has been monkeying with the handgun.

A further object of my invention is to provide a firearm safety device which can also be used as a gun barrel cleaning device.

Still another object of my invention is to provide a firearm safety device which is adapted to be used with handguns of various types, i.e. revolver, semiautomatic and others and adapted to all different caliber handguns with different length barrels.

It is also an object of my invention to provide a firearm safety device which in addition to being childproof, may include a secondary security system having a conventional locking device, to prevent removal by unauthorized older children and adults. The secondary security system has been previously described and claimed in U.S. patent application Ser. No. 09/543,285.

LIST OF REFERENCE NUMERALS

Figure 1:
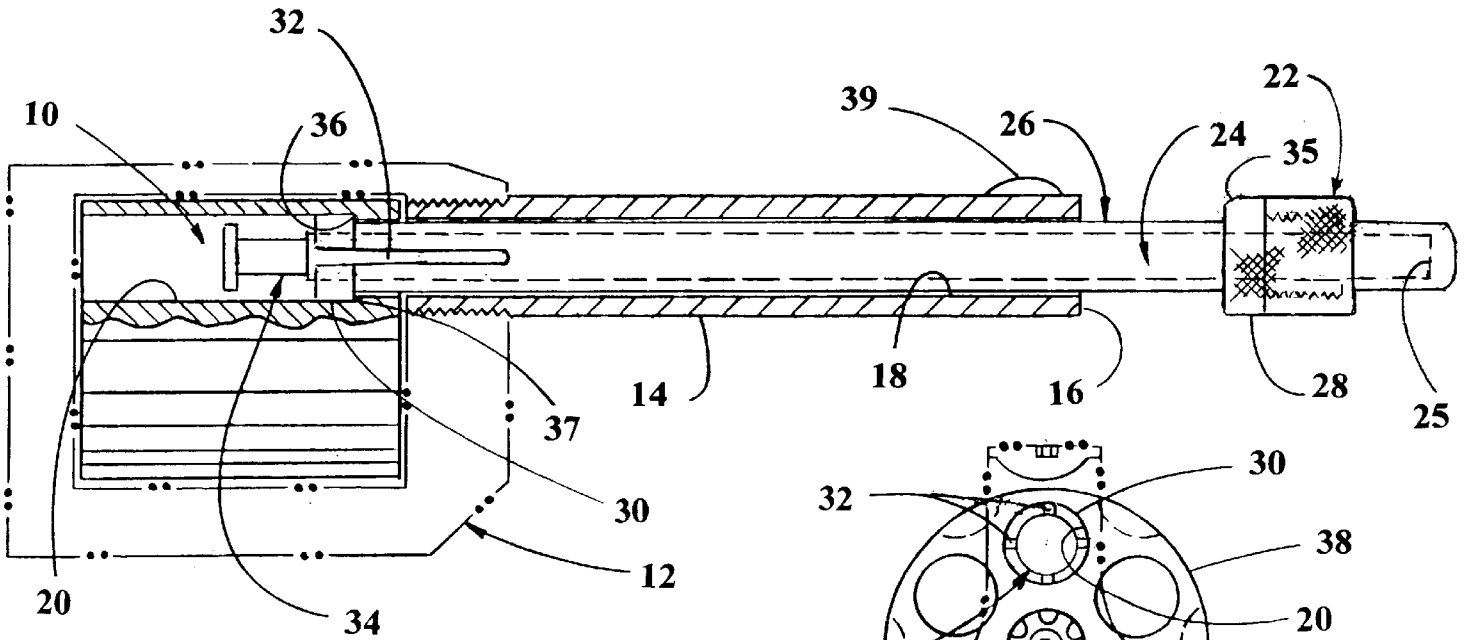
FIG. 1 is a side view, partly in cross-section, illustrating the firearm safety device invention assembled in the cylinder and barrel of a revolver handgun.

10 firearm safety device
12 revolver handgun
14 barrel
16 muzzle
18 bore
20 firing chamber
22 knurled cap
24 lock rod
25 circular cavity
26 lock sleeve
27 thread
28 knurled enlarged end portion
30 opposite end plug
32 linear slot
34 removable tip
35 observation notch
36 shoulder
37 shoulder
38 cylinder
39 front sight
40 semiautomatic handgun
42 hole

44 thread
46 female thread
47 opposite end
48 threaded end portion
50 control portion
52 neck portion
54 retainer portion
55 junction
56 firearm safety device
58 adjustable lock rod
60 stepped end portion
62 step
64 adjusting screw
66 male thread
68 female thread
70 opposite end portion
72 caliber indicating line
74 edge
76 removable tip
78 threaded end portion
80 control portion
82 cleaning tip
84 cleaning tip
86 cleaning tip
88 cleaning tip

DESCRIPTION OF PREFERRED EMBODIMENTS FIGS. 1–5

Referring now to the drawings and more particularly FIG. 1, it can be seen that a firearm safety device according to the invention is designated generally by the numeral 10. As will become apparent herein, firearm safety device 10 is intended to serve as a firing chamber block mechanism, securing the barrel and firing chamber of the firearm on which it is employed. Firearm safety device 10 shown in the assembly drawing of FIG. 1, for a revolver handgun 12, has a barrel 14 extending to a muzzle 16. A bore 18 extends axially into barrel 14 from muzzle 16 in standard fashion. As will become further apparent herein, bore 18 typically terminates at a firing chamber 20 of a revolver handgun 12.

Figure 3:
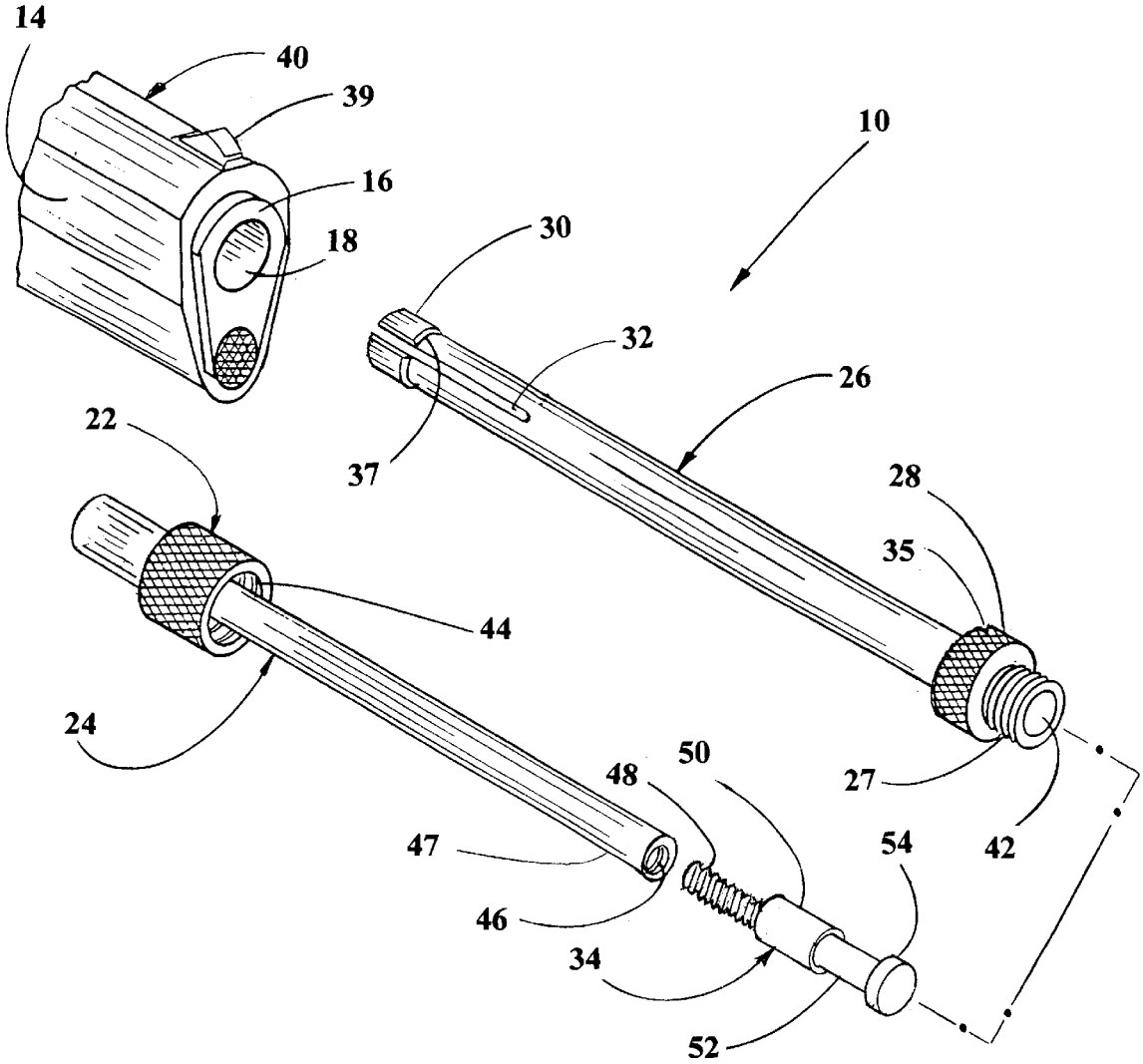
FIG. 3 is an assembly diagram of the safety device invention, shown in FIG. 1, as applicable to a semiautomatic handgun.

Firearm safety device 10 includes a knurled cap 22 with a lock rod 24, securely fastened into a circular cavity 25 of knurled cap 22. As shown, lock rod 24 is inside a lock sleeve 26 which is assembled in bore 18. Knurled cap 22 is threaded to a mating thread 27 on a knurled enlarged end portion 28 of lock sleeve 26, as shown in FIG. 3. An opposite end plug 30 on lock sleeve 26 is positioned in firing chamber 20, preventing insertion of a cartridge into firing chamber 20. A number of linear slots 32 in end plug 30 provide the flexibility needed in the insertion and removal of end plug 30 from bore 18. As further shown in FIG. 1, lock sleeve 26 cannot be removed from barrel 14, while a removable tip 34, of lock rod 24, is in touching contact with end plug 30, which prevent the diametrical contraction of end plug 30 necessary for removal from barrel 14. Unthreading knurled cap 22 from knurled enlarged end portion 28 of lock sleeve 26, allows lock rod 24 and lock sleeve 26 to be withdrawn from bore 18, since removable tip 34 is no longer in contact with end plug 30. This allows the contraction of end plug 30 necessary for withdrawal from firing chamber 20.

It will be appreciated by those skilled in the art that the firing chamber 20 has a slightly greater inside diameter than bore 18, the departure between the firing chamber 20 and bore 18 being defined by a shoulder 36 of the firing chamber 20 adapted for contacting the rim of a cartridge, and a shoulder 37 of the end plug 30.

Figure 2:
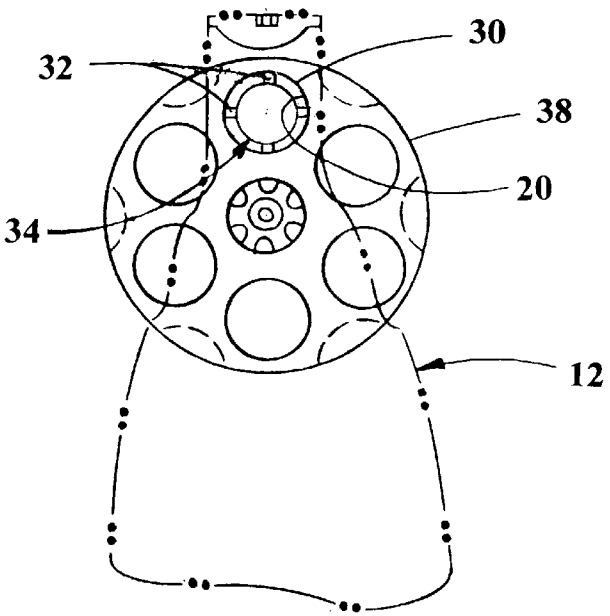
FIG. 2 is a rear broken away and phantom view of the revolver, showing an end view of the safety device invention in the firing chamber.

FIG. 2 is a rear view of a cylinder 38, in revolver handgun 12, showing removable tip 34 of firearm safety device 10 positioned in firing chamber 20. Lock rod 24 forces diametrical expansion of end plug 30 to a diameter slightly less than the inside diameter of firing chamber 20 and sufficiently more than the inside diameter of bore 18 of barrel 14, preventing removal of firearm safety device 10 from revolver handgun 12.

FIG. 3 is an assembly diagram of firearm safety device 10 disclosed and described in FIG. 1 and FIG. 2 as applied to a semiautomatic handgun 40. Firearm safety device 10 invention is designed to be used on most any type of handgun, i.e. revolver handgun 12, semiautomatic handgun 40 and others. The firearm safely device 10 is also designed to fit a wide range of handgun barrel lengths, since the knurled cap 22 of firearm safety device 10 protrudes an inch more or less from muzzle 16 of barrel 14. This allows firearm safety device 10 to be used in handguns with different length barrels. A stretched out, longer version of the invention can be made for use in handguns with extra long barrels.

Firearm safety device 10 is also designed for use in handguns of different calibers. The smallest caliber handgun which firearm safety device 10 can be used with must be slightly larger than the outside diameter of lock sleeve 26, to allow free axial movement of end plug 30 within firing chamber 20. The largest caliber handgun in which the firearm safety device 10 can be used is limited by the maximum diameter expansion of end plug 30. This maximum diameter occurs when the diameter of removable tip 34 of lock rod 24 is about the same as the diameter of the rest of lock rod 24.

Firearm safety device 10 as designed covers a range of calibers spread apart by about 0.10 inches. To fit all conventional caliber handguns, from say 0.22 to 0.45 caliber, about two different sizes of firearm safety device 10 would be necessary. For the small calibers, such as 0.22 and 0.25, it may be necessary to manufacture lock rod 24 from metal instead of plastic in order to provide added rigidity to firearm safety device 10.

When removal of firearm safety device 10 is attempted, without first withdrawing lock rod 24, shoulder 37 of end plug 30 of lock sleeve 26 will abut against shoulder 36 of firing chamber 20 preventing removal of firearm safety device 10.

As shown in FIG. 3 a female thread 44 in knurled cap 22 is designed to mate with male thread 27 on knurled enlarged end portion. Also shown is a female thread 46, in an opposite end 47, of lock rod 24 designed to mate with a threaded end portion 48 on removable tip 34.

Referring to FIGS. 1–3, to assemble firearm safety device 10, lock rod 24 is inserted in lock sleeve 26 thru a hole 42. The threaded end portion 48 of removable tip 34 is next matingly threaded to thread 46 in lock rod 24. The assembled firearm safety device 10 can then be inserted into muzzle 16 thru barrel 14 and into firing chamber 20, as shown in FIG. 1. Threading knurled cap 22 to knurled enlarged end portion 28, positions a control portion 50, of removal tip 34, into end plug 30 of lock sleeve 32. This causes the expansion of end plug 30 within firing chamber 20, locking firearm safety device in revolver handgun 12, as shown in FIGS. 1 and 2, or semiautomatic handgun 40, as shown in FIG. 3.

In removal of firearm safety device 10, knurled cap 22 is completely unthreaded from knurled enlarged end portion 28 which moves control portion 50 out of end plug 30. At the same time, moving a neck portion 52, of removable tip 34, having an outside diameter less than the outside diameter of control portion 50, into end plug 30. This allows the contraction of end plug 30, necessary for removal of firearm safety device 10 from handguns.

A retainer portion 54 of removable tip 34 has an outside diameter smaller than the inside diameter of bore 18 and larger than the inside diameter of lock sleeve 26, preventing separation of lock rod 24 and lock sleeve 26, when knurled cap 22 has been unthreaded from knurled enlarged end portion 28.

FIGS. 1 and 3 also show a tamper evident feature of the invention having an observation notch 35 of knurled enlarged end portion 28 of lock sleeve 26. Rotation of lock sleeve 26 allows observation mark 35 to be aligned with front sight 39, or any other prominent feature, of revolver handgun 12 and semiautomatic handgun 40. With the tamper evident feature, the gun owner can tell at a glance if tampering has occurred.

Figure 4:
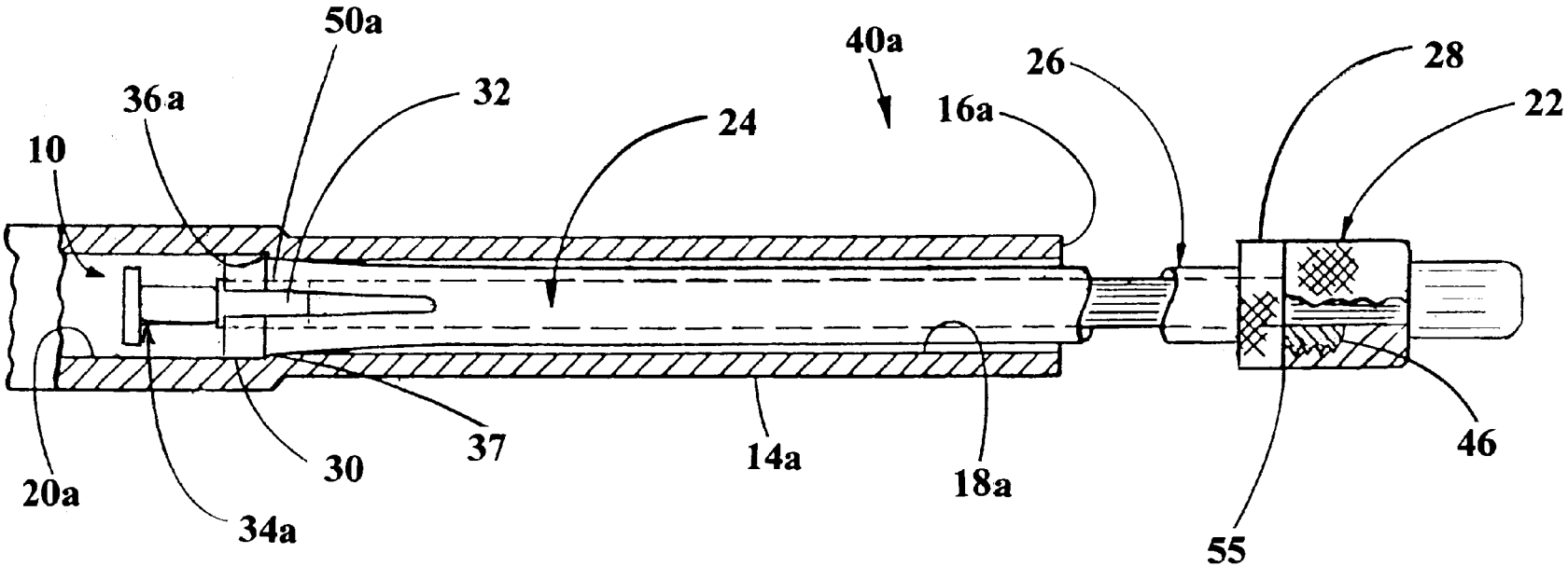
FIG. 4 is a side view, partly in cross-section, of the safety device invention assembled in the firing chamber and barrel of a relatively large caliber semiautomatic handgun.
Figure 5:
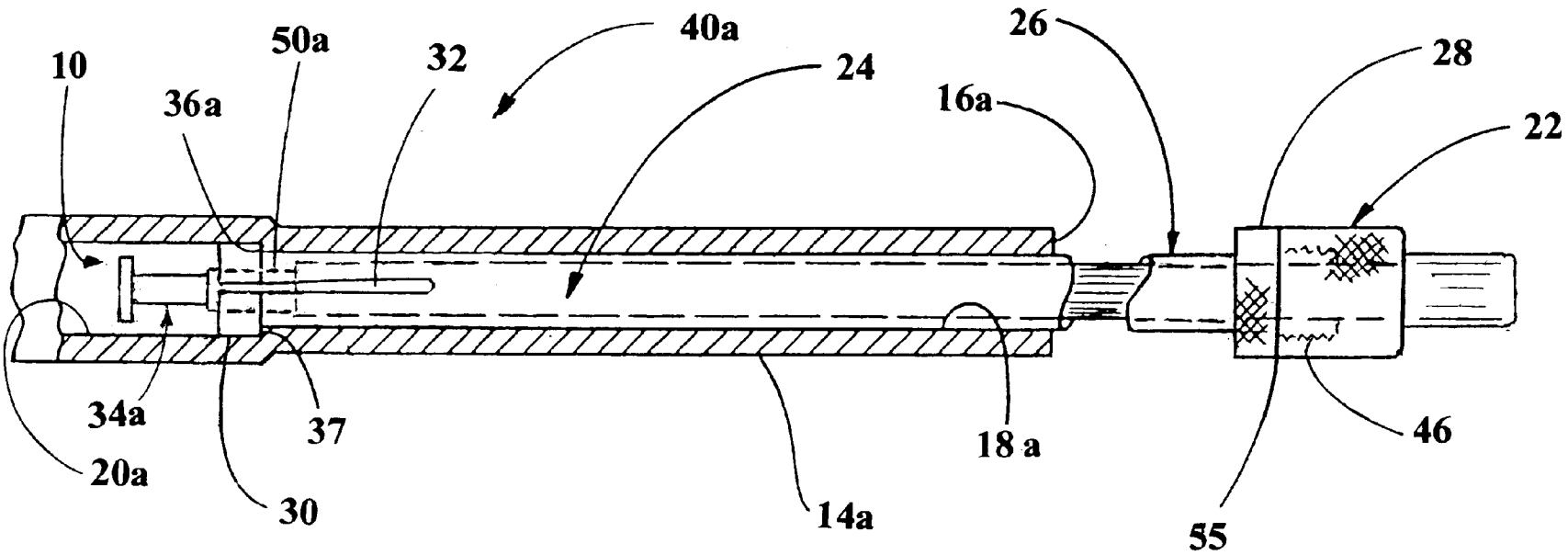
FIG. 5 is a side view, partly in cross-section of the safety device invention assembled in the firing chamber and barrel of a relatively small caliber semiautomatic handgun.

FIG. 4 shows firearm safety device 10 positioned in firing chamber 20*a* and barrel 14*a* of a relatively large caliber semiautomatic handgun 40*a* which is of larger caliber than semiautomatic handgun 40. In FIGS. 4 and 5, elements which are not interchangeable, but similar to those in FIG. 3, are identified with the same numerals followed by the letter "a" as shown in FIG. 4, control portion 50*a* of removable tip 34 has a diameter equal to the rest of lock rod 24 which causes the full outside diameter expansion of end plug 30. The flexibility needed in end plug 30 for expansion or contraction is provided by linear slots 32 in lock sleeve 26, as previously discussed.

A junction 55, between knurled cap 22 and enlarged end portion 28 of lock sleeve 26, as shown in FIG. 1, is a nearly invisible circular line where knurled cap 22 and knurled enlarged end portion 28 are joined. As assembled, firearm safety device 10 is free to rotate axially and also have some limited movement longitudally as designed, but can not be removed from barrel 14*a* without following the proper removal procedure. A child attempting to remove firearm safety device 10 will rotate, push and pull knurled cap 22 but will be unsuccessful since the child will hold the handgun in one hand and try to remove knurled cap 22 with the other hand. It is highly unlikely the child will hold knurled enlarged end portion 28 stationary with one hand while unscrewing the tightly attached knurled cap 22 with the other hand, which is the proper removal procedure.

FIG. 5 shows firearm safety device 10 positioned in firing chamber 20*a* and barrel 14*a* of a semiautomatic handgun 40*a* which is of smaller caliber than that shown in FIG. 4 As shown, lock rod 24 has a smaller diameter control portion 50*a*, of removable tip 34 to cause the desired outside diameter expansion of end plug 30 of lock sleeve 26. Linear slots 32 in lock sleeve 26 provide the flexibility required for expansion of end plug 30.

Firearm safety device 10 for revolver handgun 12 shown in FIGS. 1 and 2, and semiautomatic handguns 40 and 40*a* shown in FIGS. 3, 4 and 5 are basically the same. The only difference is, that for each different caliber handgun, control portion 50*a* of removable tip 34 of lock rod 24, will necessarily have a correspondingly different diameter.

DESCRIPTION OF ALTERNATE EMBODIMENTS, FIGS. 6, 7 AND 8

Figure 6:
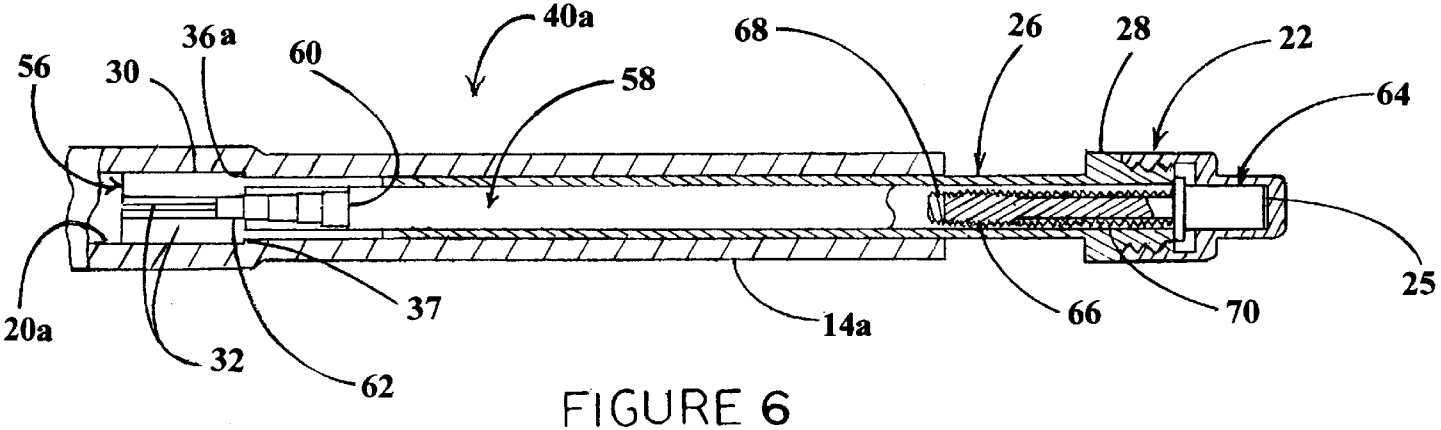
FIG. 6 is a side view; partly in cross-section of an alternate embodiment adjustable lock rod for the safety device invention in a relatively small caliber semiautomatic handgun.

FIG. 6 is a side view, partly in cross-section, of a firearm safety device 56 installed in a relatively small caliber semiautomatic handgun 40*a*.

A firearm safety device 56 includes knurled cap 22 with an adjustable lock rod 58 positioned in a circular cavity 25 of knurled cap 22. As shown adjustable lock rod 58 is inside a lock sleeve 26 which is assembled in barrel 40. Knurled cap 22 is threaded to mating thread 27 on a protruding knurled enlarged end portion 28 of lock sleeve 26. End plug 30 on lock sleeve 26 is positioned in firing chamber 20, preventing insertion of a cartridge into firing chamber 20. A number of linear slots 32 in end plug 30 provide the flexibility needed in the insertion and removal of end plug 30 from barrel 14*a*. As further shown in FIG. 6, lock sleeve 26 cannot be removed from barrel 14*a*, as adjustable lock rod 58, is adjusted to be in touching contact with end plug 30, preventing the diametrical contraction of end plug 30 necessary for removal from barrel 14. Removal of adjustable lock rod 58 from lock sleeve 26 allows for contraction of end plug 30 and easy removal of lock sleeve 26 from barrel 14*a*. As shown, a stepped end portion 60 of adjustable lock rod 58 provides for the proper expansion of end plug 30 to a diameter more than the inside diameter of barrel 14*a*; but slightly less than the inside diameter of firing chamber 20, which allows free axial movement of end plug 30 within firing chamber 20 but prevents removal from barrel 14*a*

Also shown in FIG. 6, a step 62, the smallest of step end portion 60 of adjustable lock rod 58, is positioned in end plug 30 with shoulder 37, of end plug 30 of lock sleeve 26, abutted against shoulder 36 of firing chamber 20, preventing removal of firearm safety device 56. An adjusting screw 64, of adjustable lock rod 58, controls the positioning of the proper step 62 in end plug 30 for the particular handgun caliber. A male thread 66 of adjusting screw 64 mates with a female thread 68 in an opposite end portion 70 of adjustable lock rod 58.

Figure 7:
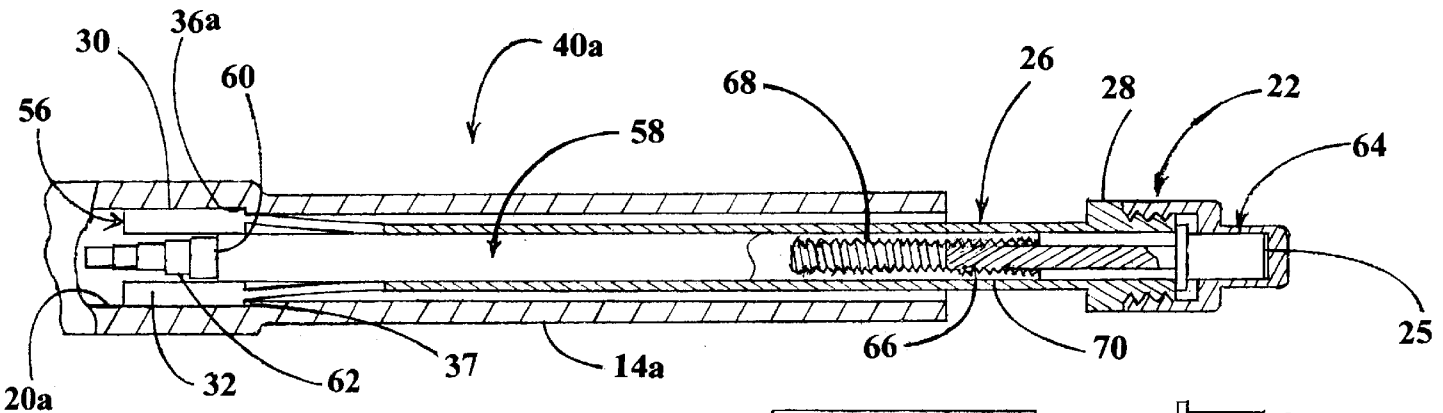
FIG. 7 is a side view, partly in cross-section of an alternate embodiment adjustable lock rod for the safety device invention in a relatively large caliber semiautomatic handgun.

FIG. 7 shows firearm safety device 56 positioned in firing chamber 20*a* and barrel 14*a* of a relatively large caliber semiautomatic handgun 40*a*. As shown in FIG. 7, the largest step 62*a* of stepped end portion 60 of adjustable lock rod 58, is positioned in end plug 30 with shoulder 37 of end plug 30 of lock sleeve 26 abutted against shoulder 36 of firing chamber 20, preventing removal of firearm safety device 56.

Figure 8:
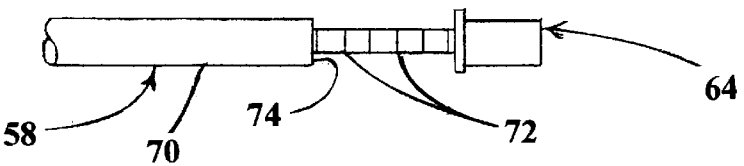
FIG. 8 is a partial side view of the adjustable lock rod and the adjusting screw for the safety device invention.

FIG. 8 shows a caliber indicating line 72 marked or embossed on adjusting screw 64, threadedly attached to adjustable lock rod 58. Alignment of a specific caliber indicated line 72 with an edge 74 of opposite end portion 70 of adjustable lock rod 58, provides the correct adjustment for the firearm safety device 58 for that caliber handgun.

Figure 9:
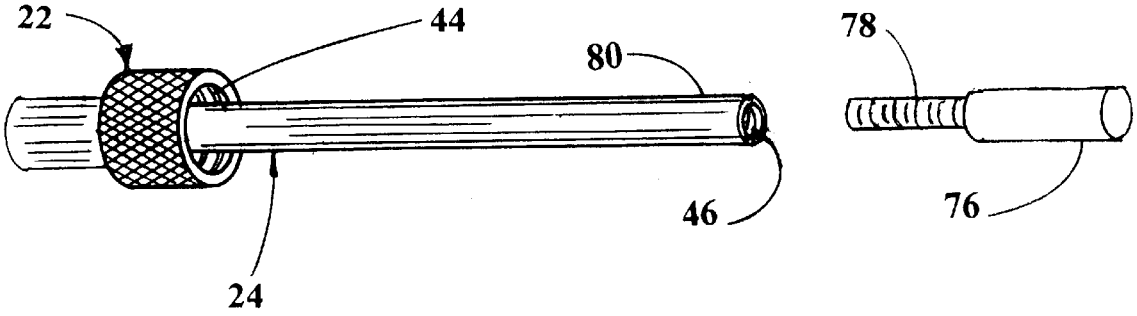
FIG. 9 is a side view of another alternate embodiment for the safety device invention showing an alternate lock rod.

FIG. 9 is a side view of another alternate embodiment for firearm safety device 10 invention. As shown, a removable tip 76, having a threaded end portion 78, threadedly attaches to female thread 46 in an opposite end 47 of lock rod 24. A control portion 80, of removable tip 76, will have a different outside diameter for each different caliber handgun in a similar manner as control portion 50, of removable tip 34, as previously described for FIGS. 1–5.

Figure 10:
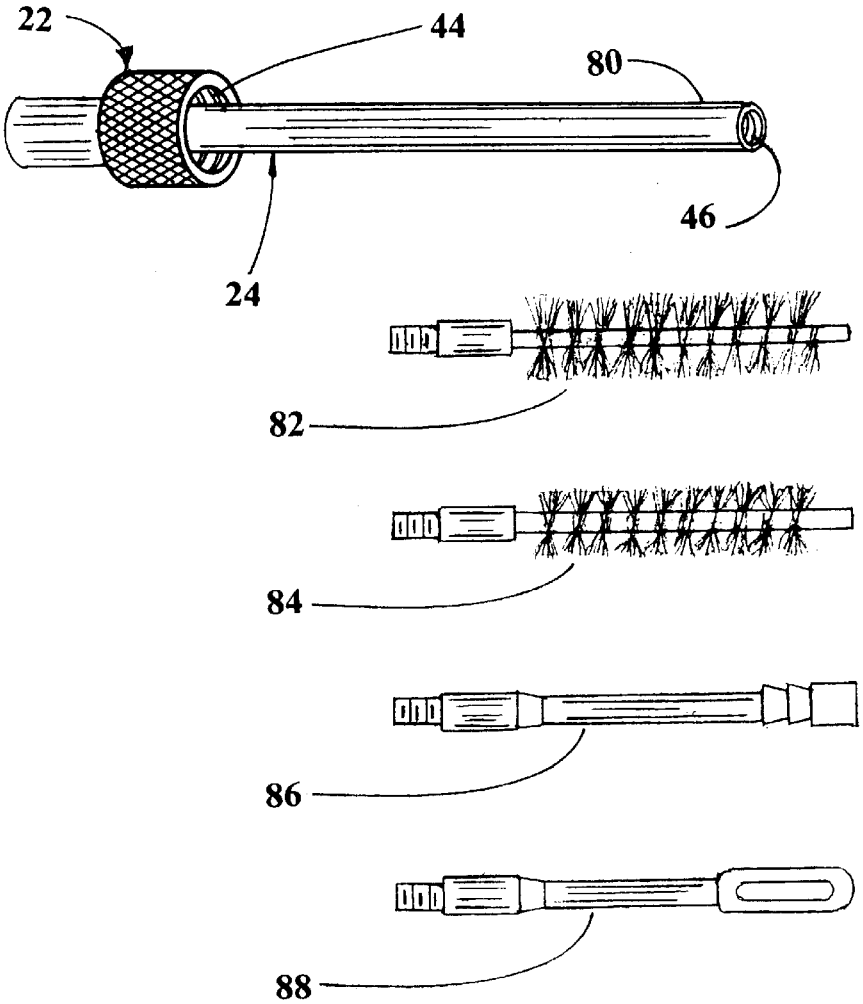
FIG. 10 is a side view of a further alternate embodiment of the invention showing utilization of commercially available barrel cleaning tips.

FIG. 10 is a side view of still another alternate embodiment for firearm safety device 10 invention. As show lock rod 24, with attached knurled cap 22, can be used separately as a cleaning rod for revolver handgun 12 and semiautomatic handgun 40. A cleaning tip 82, 84, 86 or 88 threadedly attaches in standard fashion, to female thread 46 in opposite end 47 of lock rod 24. Cleaning tips 82, 84, 86 and 88 are representative of some currently commercially available brush and patch type cleaning tips.

OPERATION OF THE INVENTION

The operational procedure for installing or removing firearm safety device 10 invention from revolver handgun 12, shown in FIG. 1, and semiautomatic handgun 40, shown in FIG. 3, is the same.

Referring to FIGS. 1–3, to assemble firearm safety device 10, knurled cap 22 is securely fastened to lock rod 24, with lock rod 24 positioned in circular cavity 25. Lock rod 24, with permanently attached knurled cap 22, is then inserted into lock sleeve 26, by having opposite end 47, of lock rod 24, being inserted into hole 42 of lock sleeve 26. With lock rod 24 fully inserted, removable tip 34 is threadedly attached to lock rod 24 by having threaded end portion 48, of removable tip 34, threaded tightly to thread 46 of lock rod 24. The assembled firearm safety device 10, can then be inserted into muzzle 16, thru barrel 14, and into firing chamber 20 of revolver handgun 12 as shown in FIG. 1, Threading knurled cap 22 tightly to knurled enlarged end portion 28 of lock sleeve 26, securely locks firearm safety device 10 in revolver handgun 12, in a manner previously described. Unthreading knurled cap 22 from knurled enlarged end portion 28, allows the assembled firearm safety device 10 to be quickly removed from revolver handgun.

Assume that firearm safety device 10 is positioned within revolver handgun 12 and quick removal is necessary in an emergency situation. A person following the proper removal procedure will hold revolver handgun 12 in one hand and use several fingers of the same hand to hold knurled enlarged end portion 28 of lock sleeve 26 stationary, while unthreading knurled cap 22 with the other hand. This allows removal of firearm safety device 10 from revolver handgun 12.

Assuming now a child, in some way, has gained access to revolver handgun 12 with firearm safety device 10 positioned therein and tries to remove firearm safety device 10. The child will be unsuccessful despite various manipulations that will be tried. Holding revolver handgun 12 in one hand and trying to push, pull, and rotate knurled cap 22 in either direction with the other hand will be unsuccessful since firearm safety device 10 is designed to move freely back and forth a half inch, more or less, and is free to rotate in either direction. Further, the child is physically unable to hold revolver handgun 12 and use fingers of the same hand to hold knurled enlarged end portion 28 of lock sleeve 26 stationary while trying with the other hand to unthread knurled cap 22. Unthreading knurled cap 22 is the key step in removal of firearm safety device 10 as previously explained.

Efforts by two children, one holding revolver handgun 12 and the other pulling on firearm safety device 10, will fail to remove firearm safety device 10, as a test on a model of the invention showed that a pull of 125 pounds of force was unsuccessful in removing firearm safety device 10.

FIGS. 6–8 illustrates an alternate embodiment of the invention showing adjustable lock rod 58 which can be substituted for lock rod 24 shown in FIGS. 1–5.

Firearm safety device 56 includes knurled cap 22 with adjustable lock rod 58 positioned in circular cavity 25 of knurled cap 22. As shown in FIGS. 6 and 7, adjustable lock rod 58 is inside a lock sleeve 26 which is assembled in barrel 14*a*. Knurled cap 22 is threaded to the protruding knurled enlarged end portion 28 of lock sleeve 26. Plug 30 on lock sleeve 26 is positioned in firing chamber 20*a*. A plurality of linear slots 32, in end plug 30, provide the flexibility needed in the insertion and removal of end plug 30 from barrel 14*a*. As further shown in FIGS. 6 and 7, lock sleeve 26 cannot be removed from barrel 14*a*, as adjustable lock rod 58, is adjusted to be in touching contact with end plug 30, preventing the diametrical contraction of end plug 30 necessary for removal from barrel 14*a*. Removal of adjustable lock rod 58 from lock sleeve 26 allows for contraction of end plug 30 and easy removal of lock sleeve 26 from barrel 14*a* As shown, a stepped end portion 60 of adjustable lock rod 58 provides for the proper expansion of end plug 30 to a diameter more than the inside diameter of barrel 14*a* but slightly less than the inside diameter of firing chamber 20, which allows free axial movement of end plug 30 within firing chamber 20 but prevents removal from barrel 14*a*.

When assembling lock sleeve 26 into bore 18 of barrel 14, end plug 30 which is flexible is easily guided into bore 18. Lock sleeve 26 is then pushed until end plug 30 fully enters firing chamber 20. With lock sleeve 26 in place, adjustable lock rod 58 is then fully inserted in lock sleeve 26 to allow stepped end portion 60 of adjustable lock rod 58 to enter and expand end plug 30 of lock sleeve 26. Each step 62 of the stepped end portion 60 is dimensioned for a specific caliber. Adjusting screw 64 having a male thread 66 is threadedly attached to a female thread 68 in an opposite end portion 70 of adjustable lock rod 58. After adjustable lock rod 58 is positioned in lock sleeve 26, thread 44 on knurled cap 22 can be threaded together with thread 27 on knurled enlarged end portion 28 of lock sleeve 26.

FIG. 8 shows the caliber indicating lines 72 marked or embossed on adjusting screw 64, threadedly attached to adjustable lock rod 58. Alignment of a specific caliber indicating line 72 with edge 74 of opposite end portion 70 of adjustable lock rod 58, provides the correct adjustment for the firearm safety device 56 for that caliber handgun.

FIG. 9 illustrates a second alternate embodiment for the invention, showing a different type of removable tip 76, which is simpler than removable tip 34, shown in FIG. 3. These removable tips, 76 and 34, are interchangeable in lock rod 24, and operate the same way to lock firearm safety device 10 in revolver handgun 12. Their only difference is in the installation and removal of firearm safety device 10, from revolver handgun 12. In the alternate embodiment, removable tip 76, while threaded to lock rod 24, does not hold lock rod 24 and lock sleeve 26 together. In the preferred embodiment, removable tip 34, while threaded to lock rod, 24, holds lock rod 24 and lock sleeve 26 together and can be installed or removed more quickly from revolver handgun 12.

For each different caliber handgun, control portion 80 of removable tip 76 and control portion of 50 of removable tip 34 will have the same outside diameters.

FIG. 10 illustrates another alternate embodiment for the invention showing how lock rod 24, of firearm safety device 10, can be adapted for cleaning revolver handgun 12. Cleaning tips 82, 84, 86 or 88 are representative of brush and patch commercially available cleaning tips. With cleaning tip 82, 84, 86 or 88 attached, lock rod 24 is converted to a gun cleaning rod and can be used in standard fashion for cleaning revolver handgun 12 or most any other handguns.

I claim:

1. A firearm safety device for insertion in a barrel and a firing chamber of a firearm to prevent firing comprising:

(a) A lock rod extending from a knurled cap having a removable tip on an opposite end, (b) A lock sleeve, in which said lock rod is positioned having a knurled enlarged end portion and an opposite end plug, (c) said removable tip of said lock rod having a control portion to control the necessary expansion of an end plug of said lock sleeve into a securing position in said firing chamber, (d) said end plug of said lock sleeve further includes a plurality of linear slots to allow the diametrical expansion of said end plug, (e) means for attaching said lock rod to said lock sleeve, wherein said attachment means comprises said knurled cap and said knurled enlarged end portion tightly threadedly attached together having a nearly invisible line at a junction, (f) a shoulder of said end plug abutting a shoulder in said firing chamber preventing withdrawal of said lock sleeve from said firing chamber, (g) an observation notch in said knurled enlarged end portion of said lock sleeve, can be aligned with a front sight or other part of the handgun, as a tamper evident indicator.

2. The firearm safety device as defined in claim 1 wherein said control portion of said removable tip of said lock rod may have a different diameter for different caliber handguns.

3. The firearm safety device as defined in claim 1 wherein the expanded diameter of said end plug of said lock sleeve is greater than the diameter of a bore of said barrel and less than the diameter of said firing chamber, allowing relatively free rotational movement of said firearm safety device in the handgun.

4. The firearm safety device as defined in claim 1 wherein said firearm safety device protrudes an inch more or less from a muzzle of said barrel to allow said firearm safety device to be used with handguns with different lengths of said barrels.

5. The firearm safety device as defined in claim 1 wherein said removable tip has a neck portion having an outside diameter smaller than that of said control portion, to allow the required diametrical contraction of said end plug, necessary for removal of said firearm safety device from the handgun, after said knurled cap is unthreaded from said knurled enlarged end portion.

6. The firearm safety device as defined in claim 1 wherein said removable tip has a retainer portion having an outside diameter smaller than an inside diameter of said bore of said barrel, and greater than an inside diameter of said lock sleeve, to prevent separation of said lock rod, when unthreaded from said lock sleeve, for removal from said firearm safety device.

7. The firearm safety device as defined in claim 1 wherein said lock rod, said lock sleeve and said knurled cap are plastic.

8. The firearm safety device as defined in claim 1 wherein said lock rod and said knurled cap are a single part.

9. The firearm safety device as defined in claim 1 wherein said firearm safety device is adaptable to rifles and shotguns.

* * * * *